United States Patent [19]

Elliott

[11] 4,375,934

[45] Mar. 8, 1983

[54] LIFTING AND POSITIONING APPARATUS FOR CONSTRUCTION PANELS

[76] Inventor: Louis T. Elliott, Rte. 1, Rimini, S.C. 29131

[21] Appl. No.: 195,256

[22] Filed: Oct. 8, 1980

[51] Int. Cl.[3] ..... E04G 21/14

[52] U.S. Cl. ..... 414/11; 248/354 S; 248/408; 254/108

[58] Field of Search ..... 414/10, 11; 254/108, 254/133 A; 248/354 R, 354 S, 408, 409

[56] References Cited

U.S. PATENT DOCUMENTS

| | | | |
|---|---|---|---|
| 763,768 | 6/1904 | Kerns et al. | 248/354 R |
| 1,257,216 | 2/1918 | Greutmann et al. | 254/108 |
| 1,564,643 | 12/1925 | Symons | 254/133 A X |
| 1,606,101 | 11/1926 | Russell | 414/11 |
| 1,775,272 | 9/1930 | Bosco | 248/354 R |
| 1,890,966 | 12/1932 | Bullis | 248/354 R |
| 2,378,984 | 6/1945 | Couture | 248/354 R |
| 2,506,508 | 5/1950 | Kmita | 248/354 S |
| 2,586,227 | 2/1952 | Henderson | 414/10 |
| 2,729,423 | 1/1956 | Green | 248/354 R X |
| 3,208,555 | 9/1965 | Fry | 414/11 X |
| 3,305,219 | 2/1967 | Rhodes | 414/11 |
| 4,036,475 | 7/1977 | Singleton | 414/11 X |

*Primary Examiner*—Leslie J. Paperner

*Attorney, Agent, or Firm*—Lane, Aitken & Kananen

[57] ABSTRACT

A lifting and positioning apparatus for construction panels such as sheet rock, the apparatus including at least one lifting standard having a base, a fixed strut supported vertically from the base, a movable strut supported from the fixed strut, a guide and latch arrangement for retaining the struts in generally parallel relationship, a handle on the movable strut for elevating same in relation to the fixed strut and the base, and a panel engaging rail supported on the movable strut. The panel engaging rail may be supported at the top of the movable strut, in which case, two of the standards are used to elevate and position a panel against the underside of a ceiling framework. In an alternative embodiment, only one standard is used and includes a cleat-like rail at the bottom of the movable strut to engage the lower edge of a panel to be elevated along a vertical wall framework.

9 Claims, 4 Drawing Figures

56
16
P
40'
10'
44
20
14
18'
54
12'

LIFTING AND POSITIONING APPARATUS FOR CONSTRUCTION PANELS

BACKGROUND OF THE INVENTION

1. Field of the Invention

This invention relates to lifting and positioning apparatus for construction panels. More particularly, the invention concerns lifting standards by which sheet rock and other similar panel-type materials used in the building industry may be easily lifted, placed and retained temporarily in position for subsequent permanent installation.

2. Prior Art

Sheet rock and other forms of interior surface finishing panels used in the building industry are traditionally applied to ceiling and wall framing by placing sheets on the order of 4' by 8', 4' by 12' or larger against the framing and securing each sheet in place by nailing, screwing, adhesive bonding or by a combination of fastening techniques to achieve permanent installation of adjacent panels or sheets. Because of the size of each sheet or panel, the installation procedure most often requires at least two persons, particularly where each sheet must be retained in an elevated position while nails or screws are inserted. Also it is usually necessary that one or both of the two persons manually retain the sheet in position with one hand while inserting the fastening nails or screws with the other. The installation is complicated further by the requirement in many cases that both persons use step ladders, scaffolding or other forms of movable platforms in order to reach the sheet in its ultimate position.

To facilitate the installation of sheet rock and other such panel-type materials, it has been proposed in the past to use an elevating support on which an individual sheet or panel is placed for subsequent lifting, placement and retention in position where the sheet or panel can be nailed or otherwise permanently fixed to the interior of a ceiling or wall frame. In this respect, the disclosure of U.S. Pat. No. 1,606,101, issued Nov. 9, 1926 to E. M. Russell is exemplary. While devices of the type heretofore proposed have fulfilled their intended objective and, if available, would greatly simplify the installation of sheet rock and similar panels, they have not been available in fact. It is believed that the unavailability of such apparatus is due in substantial measure to the relatively complicated structural organization of prior designs coupled with an inclination by the industry to avoid other than a minimal inventory of tools and appliances. There is a need, therefore, for an inexpensive and easily handled apparatus for lifting, placing and retaining sheet rock and similar building panels as an incident to the permanent installation of such materials.

SUMMARY OF THE INVENTION

In accordance with the present invention, apparatus is provided for lifting, placing and temporarily retaining sheet rock or other panels in a manner such that the problems traditionally experienced with such handling are substantially avoided. The apparatus takes the form of a light-weight lifting standard having a pair of vertically oriented, adjacent struts, one of the struts being retained in an upright position on a stand or base whereas the other strut carries a sheet rock supporting rail and is retained in sliding engagement against the first mentioned of the two struts. A latching arrangement is provided so that a sheet rock panel supported on the rail initially at a relatively low elevation, may be raised and retained in place during nailing, screwing or otherwise permanent fixing of the sheet rock or panel in place.

In one embodiment, the lifting standards are used in pairs so that opposite ends of a single panel may be supported on separate standards, the supporting rail being positioned at the top of the movable strut. In another embodiment designed primarily for the installation of panels on wall framing, the supporting rail is in the nature of a ledge on which the panel is supported on edge for lifting and retention in an elevated position against a vertical wall, for example.

A primary object of the present invention is, therefore, to provide a simply constructed, low-cost, lightweight and easily manipulated lifting standard for use in the placement of sheet rock or panels of other material. Other objects and further scope of applicability of the present invention will become apparent from the detailed description to follow taken in conjunction with the accompanying drawings wherein in like parts are designated by like reference numerals.

DETAILED DESCRIPTION OF THE PREFERRED EMBODIMENTS

Figure 1:
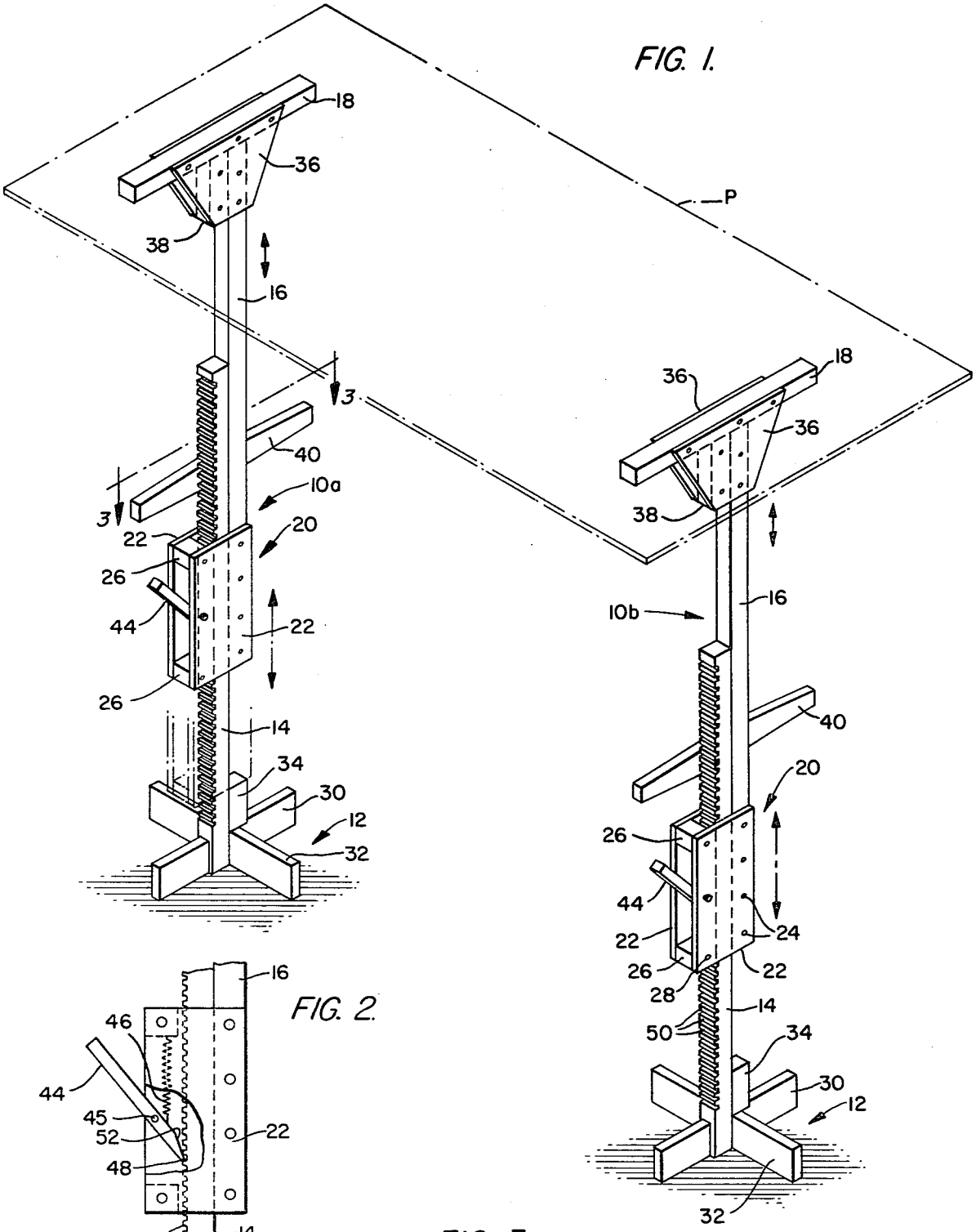
FIG. 1 is a perspective view illustrating a pair of panel lifting and placement standards in accordance with one embodiment of the present invention.

In FIG. 1 of the drawings, a panel P of sheet rock or other similar material to be installed against the underside of a ceiling framework, for example, is depicted in phantom lines as supported at the top of a pair of lifting standards 10*a* and 10*b* which are of identical construction and constitute one embodiment of the present invention. Each of the standards 10 includes a base 12, a fixed strut 14 secured in an upright position on the base 12, a vertically movable strut 16 positioned adjacent to one side of the fixed strut 14 and supporting a panel bearing cross rail 18 at the top thereof.

A guide frame 20 is fixed to the movable strut 16 and extends from the bottom of the movable strut upwardly for a distance along the lower portion of the length of the strut 16. In the illustrated embodiment, the guide frame is in the nature of a pair of plates 22 secured by suitable means such as nails or bolts 24 directly against opposite sides of the lower end portion of the movable strut 16. The width of the plates exceeds the combined width of both struts 14 and 16 and the free or extending edge portions thereof are secured to each other and to a pair of upper and lower spacer guide blocks 26 again by suitable fastening means such as screws or bolts 28. As may be seen by reference to FIGS. 1–3 of the drawings, the fixed strut 14 extends between the movable strut 16 and the spacer guide blocks 26 so that a telescopic sliding relationship is established between the fixed strut 14 on the one hand and the movable strut 16, and the guide frame 20 on the other hand. Also, the vertical dimension of the guide plates 22 and thus the spacing of the spacer guide blocks 26 will retain the parallel adjacent relationship of the struts 14 and 16.

The base 12 in the embodiment illustrated in FIG. 1 is established by a pair of cross members 30 and 32, the fixed strut 14 being secured to the cross member 30 to be slightly eccentric with respect to the intersection of the cross members 30 and 32. An abutment block 34 is fixed on top of the cross members adjacent the fixed strut 14 to be equally eccentric from the intersection of the cross members 30 and 32 and to underlie the bottom of the movable strut 16. The rail 18 is also secured to the top of the movable strut 16 by a pair of gusset plates 36. An upper abutment block 38 is secured between the gusset plates 36 in a position to overlie the top of the fixed strut 14. In light of the organization of the abutment blocks 34 and 38, when the movable strut 16 is in its lowermost position, the bottom of the movable strut 16 will engage the lower abutment block 34 whereas the top of the fixed strut 14 will be engaged by the upper abutment block 38. In light of this organization, the combined column strength of both struts 14 and 16 is used to support a load on the rail 18 when the movable strut 16 is in its lowermost position.

To elevate the movable strut 16 with respect to the lower strut 14 and the base 12, a cross handle 40 is fixedly secured such as by screws 42 to the movable strut 16 above the guide frame 20. The handle 40 thus facilitates a manual elevation or lifting of the strut 16 and the rail 18 relative to the lower strut 14. To retain the assembly of the rail 18, the movable strut 16 and the guide frame 20 in an elevated position, a latch pawl 44 is pivotally supported by a bolt 45 from the spaced free edges of the guide frame plates 22 and biased by a spring 46 so that the lower or working end 48 thereof is retained against the outer surface of the fixed strut 14 in which a series of latch teeth 50 are formed. The working end of the pawl 44 is provided with a chamfered surface 52 so that upward movement of the pawl, as during lifting movement of the strut 16, will allow the pawl to slide easily over the series of latch teeth 50. Downward movement of the strut, however, will be prevented by engagement of the working end 48 of the pawl 44 with the latch teeth 50.

Figure 2:
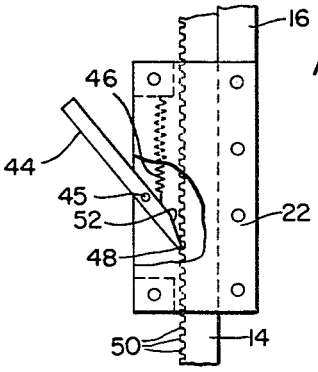
FIG. 2 is an enlarged fragmentary side elevation illustrating the guide frame and latching arrangement incorporated in the lifting standard of the present invention.
Figure 3:
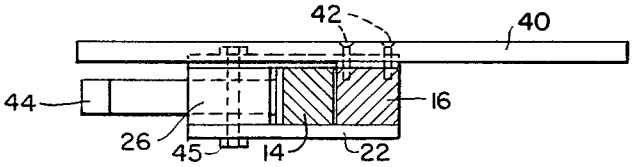
FIG. 3 is a fragmentary cross-section on line 3—3 of FIG. 1.

From the illustration of components in FIGS. 1–3 it will be appreciated that each of the lifting standards 10 may be formed entirely of wooden components and easily fabricated by a carpenter of modest skills. The struts 14 and 16 as well as the rail 18 and handle 40 may be formed easily from conventional 2"×2" lumber stock whereas the plates 22 and 36 may be fabricated of plywood. The latch 44 may also be formed of hardwood and the latch teeth require only a series of transverse saw kerfs to be formed on one surface of the fixed strut 14. The cross members 30 and 32 constituting the base 12 may be formed of readily available 2"×4" lumber stock. It is contemplated, however, that the several components may be formed of light metal such as aluminum or rolled sheet steel. In either case, the resulting standard is adequately stable and strong and more importantly, may be manipulated, handled and stored with a minimum of effort.

In the operation of the lifting standards for the placement of a panel P of sheet rock or other material in place against the underside of a ceiling framework, for example, both standards 10*a* and 10*b* are adjusted to their lowermost position by releasing the latch 44. The panel is placed on the rails 18 of both standards as shown in FIG. 1. Thereafter, the movable strut 16 of both standards may be lifted simultaneously by two persons or successively in increments by one person until the panel is slightly lower than its final position against the ceiling framework. After adjusting the lateral positioning of both standards so that the panel P is in its final lateral position, both standards are further elevated until the panel is firmly against the ceiling framework. After nailing or screwing the panel permanently in place, the latches 44 are released and the standards retracted for placement of successive panels.

Figure 4:
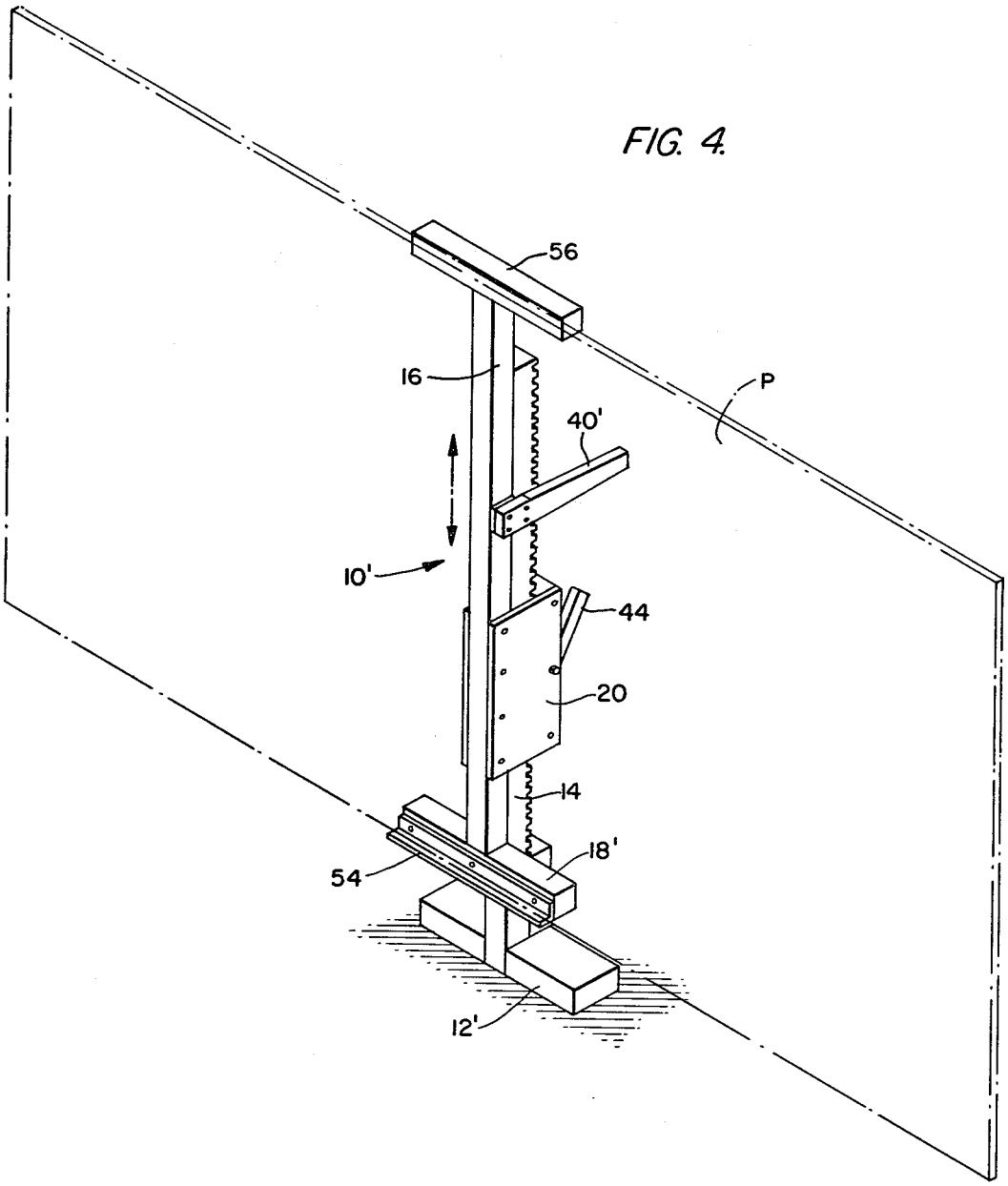
FIG. 4 is a perspective view illustrating an alternative embodiment of the invention.

In FIG. 4, an alternative embodiment of the lifting standard of the present invention is shown in which parts corresponding directly with those of the previous embodiment are identified by the same reference numerals, parts serving the same function but modified structurally are identified by the same reference numerals but primed and new parts to be described are identified by new reference numerals. Thus, the alternative embodiment of the lifting standard, identified generally by the reference numeral 10', is intended for use to position a panel P against a vertical wall framework. In this instance, the base 12' is designed to be flush with the edge of the fixed standard 14 adjacent to the movable standard 16. Also, the handle 40' extends from an end flush with the outer face of the movable strut 16. The supporting rail 18' is mounted at the bottom of the movable strut 16 and includes an angle cleat 54 of sufficient lateral extent or depth to receive the edge of the panel P. A cross piece 56 at the top of the strut 16 in this instance serves merely to stabilize the upper edge of the panel.

The operation of the embodiment illustrated in FIG. 4 is similar to that of the previous embodiment except that in this instance, the upper strut 16 will be lowered so that the rail 18' rests directly on the floor or other surface on which the base 12' is supported. Also, only one standard 10' is used. The panel P is placed on the angle ledge 54. After the panel and standard 10' are moved against the wall framework and elevated upwardly to the appropriate position, it is nailed or otherwise fixed permanently in place.

Thus it will be appreciated that as a result of the present invention, an improved lifting standard construction for placement of sheet rock and similar panels is provided. It will be equally apparent to those skilled in the art from the preceeding description that various modifications and/or changes may be made in the disclosed embodiments without departure from the present invention. Accordingly, it is intended that the foregoing description and accompanying drawings are illustrative of preferred embodiments only, not limiting, and that the true spirit and scope of the present invention be determined by reference to the appended claims.

I claim:

1. Apparatus for lifting and positioning construction panels such as sheet rock, such apparatus comprising: a pair of independent lifting standards, each standard including a base, a fixed strut supported from said base to be retained in a generally vertical orientation, a movable strut, a panel supporting rail secured at the top of said movable strut in transverse relationship thereto, guide frame means secured to the movable strut for retaining said movable strut in sliding relation adjacent to and generally parallel with said fixed strut, a lifting handle fixedly secured to said movable strut, one-way latch means carried by said guide frame means and operative normally to prevent downward movement of said movable strut relative to said fixed strut, said latch means being releasable to enable such downward movement and providing for unrestricted upward movement of said movable strut relative to said fixed strut, a lower abutment block supported by said base to underlie said movable strut, and an upper abutment block secured near the upper end of said movable strut to overlie said fixed strut, the length of both said struts being established so that said upper abutment block rests on the top of said fixed strut and the bottom of said movable strut rests on said lower abutment block when said movable strut is in its lowermost position.

2. The apparatus recited in claim 1, wherein said guide frame means comprises a pair of plates secured to opposite sides of one of said struts, said plates extending from said one strut to free edges located on the opposite side of the other of said struts from said one strut, and a pair of vertically spaced spacer guide blocks secured between said plates adjacent the free edges thereof.

3. The apparatus recited in claim 2, wherein said plates are secured to said movable strut.

4. The apparatus recited in either of claims 2 or 3, wherein said latch means comprises a latch pawl pivotally supported between said plates, the other of said struts including a series of latch teeth engagable by said latch pawl to prevent downward movement of said movable strut in relation to said fixed strut.

5. The apparatus recited in claim 1, wherein the adjacent surfaces of said fixed and movable struts are centered on said base.

6. Apparatus for lifting and positioning construction panels such as sheet rock, such apparatus comprising: at least one independent lifting standard including a base, a fixed strut supported from said base to be retained in a generally vertical orientation, a movable strut, said base being flush with the face of said fixed strut adjacent to said movable strut, guide frame means secured to the movable strut for retaining said movable strut in sliding relation adjacent to and generally parallel with said fixed strut, a lifting handle fixedly secured to said movable strut, one-way latch means carried by said guide frame means and operative normally to prevent downward movement of said movable strut relative to said fixed strut, said latch means being releasable to enable such downward movement and providing for unrestricted upward movement of said movable strut relative to said fixed strut, and a panel supporting rail fixedly secured to the bottom of said movable strut in transverse relationship thereto.

7. The apparatus recited in claim 6, wherein said handle projects from the side of said movable strut adjacent to said fixed strut and is flush with the side of said movable strut opposite from said fixed strut.

8. The apparatus recited in claim 6, wherein said supporting rail includes an angle cleat for engaging the lower edge of a panel in an upright orientation.

9. The apparatus recited in claim 6, wherein said guide frame means comprises a pair of plates secured to opposite sides of one of said struts, said plates secured to opposite sides of one of said struts, said plates extending from said one strut to free edges located on the opposite side of the other of said struts from said one strut, and a pair of vertically spaced spacer guide blocks secured between said plates adjacent the free edges thereof.

* * * * *

UNITED STATES PATENT AND TRADEMARK OFFICE

CERTIFICATE OF CORRECTION

PATENT NO. : 4,375,934

DATED : March 8, 1983

INVENTOR(S) : LOUIS T. ELLIOTT, Rimini, South Carolina

It is certified that error appears in the above—identified patent and that said Letters Patent is hereby corrected as shown below:

Column 6, Lines 26 and 27, "secured to opposite sides of one of said struts, said plates" should be omitted.

Signed and Sealed this

*Thirty-first* Day of *May 1983*

[SEAL]

*Attest:*

DONALD J. QUIGG

*Attesting Officer*

*Acting Commissioner of Patents and Trademarks*

UNITED STATES PATENT AND TRADEMARK OFFICE

CERTIFICATE OF CORRECTION

PATENT NO. : 4,375,934

DATED : March 8, 1983

INVENTOR(S) : Elliott

It is certified that error appears in the above—identified patent and that said Letters Patent is hereby corrected as shown below:

ON THE TITLE PAGE:

In the Abstract, line 2, delete "sheet rock" and insert therefor -- SHEETROCK --;

Column 1, line 9, delete "sheet";

Column 1, line 10, delete "rock" and insert therefor -- SHEETROCK --.

Please change all other occurrences of "sheet rock" which are listed below to -- SHEETROCK --:

Column 1, line 15;

Column 1, line 34;

Column 1, line 45;

Column 1, line 53;

Column 1, line 59;

Column 1, line 65;

Column 1, line 68;

Column 2, line 3;

Column 2, line 17;

Column 2, line 40;

UNITED STATES PATENT AND TRADEMARK OFFICE

CERTIFICATE OF CORRECTION

PATENT NO. : 4,375,934

DATED : March 8, 1983

INVENTOR(S) : Elliott

It is certified that error appears in the above—identified patent and that said Letters Patent is hereby corrected as shown below:

Column 3, line 64;

Column 4, line 45;

Column 4, line 57;

Column 5, line 32.

Signed and Sealed this

*Twenty-fifth* Day of *October 1983*

[SEAL]

*Attest:*

GERALD J. MOSSINGHOFF

*Attesting Officer*

*Commissioner of Patents and Trademarks*